United States Patent [19]

Sansonetti

[11] 4,087,675

[45] May 2, 1978

[54] HEATED MITTEN

[76] Inventor: Coretta Sansonetti, 502 Willow Rd., Elmhurst, Ill. 60126

[21] Appl. No.: 766,047

[22] Filed: Feb. 7, 1977

[51] Int. Cl.[2] ..... H05B 1/00

[52] U.S. Cl. ..... 219/211; 128/381; 219/527

[58] Field of Search ..... 219/211, 527–528; 128/379, 381, 402, 260; 2/158

[56] References Cited

U.S. PATENT DOCUMENTS

| | | | |
|---|---|---|---|
| 3,116,732 | 1/1964 | Cahill | 128/260 |
| 3,292,628 | 12/1966 | Maxwell et al. | 128/402 |
| 3,298,368 | 1/1967 | Charos | 219/24 X |
| 3,384,083 | 5/1968 | Cozza et al. | 128/260 |

*Primary Examiner*—C. L. Albritton

*Attorney, Agent, or Firm*—Robert D. Farkas

[57] ABSTRACT

A heated mitten for use in conjunction with the application of a hand cream or the like including an inner liquid impervious mitten for placement in the hand of the user, an outer mitten having a heated chamber for accepting the inner mitten and the hand of the user therein, means for electrically heating the heated chamber, means for regulating the temperature at which the electrical heating means operates, and means for storing hand cream within said inner mitten prior to the use thereof.

6 Claims, 3 Drawing Figures

HEATED MITTEN

BACKGROUND OF THE INVENTION

1. Field of the Invention

The present invention relates to heated mittens, and more particularly, to a heated mitten for use in conjunction with the application of a hand cream or the like.

2. Description of the Prior Art

The prior art abounds with various types of heated gloves, mittens or the like. These devices contemplate the heating of a human hand for therapeutic or beauty reasons and all include an electrical heating element affixed to a hand encompassing structure. Presently known devices are poorly suited for use in beauty salons or the like where sterilization or thorough cleaning is desired after each use in conjunction with hand creams. Also, the application of hand cream must be effected prior to the placement of the device on the hand of the user which tends to lead to an untidy situation.

U.S. Pat. No. 3,292,628 issued to J. P. Maxwell ET AL on Dec. 20, 1966 discloses an electric therapeutic glove which includes a lining shaped to conform to the hand of the user, an outer nonconductive covering, and an electrical heating element disposed between the lining and the covering.

U.S. Pat. No. 3,298,368 issued to P. Charos on Jan. 17, 1967 teaches a heated cream applicator which includes an inner hand covering, an outer hand covering, and means for heating the inner hand covering.

The present invention overcomes the shortcomings associated with the prior art by providing a heated mitten which is ideally suited for applications where the device is used repeatedly by several different users resultant of the incorporation of an inner hand cream dispensing mitten.

SUMMARY OF THE INVENTION

Therefore, a primary object of the present invention is to provide a heated mitten for use in conjunction with a hand cream or the like to facilitate absorbtion thereof by a hand inserted within the mitten.

A further object is to provide a heated mitten which may be used repeatedly by several different users without cleaning or sterilization.

A still further object is to provide a heated mitten which will maintain a preselected temperature.

Another object is to provide a hand mitten which automatically dispenses a preselected amount of hand cream or the like.

Still another object is to provide a heated mitten which is simple in design, inexpensive to manufacture and durable.

These objects, as well as further objects and advantages, of the present invention will become readily apparent after reading the description of a non-limiting illustrative embodiment and the accompanying drawing.

According to the principles of the present invention, a heated mitten includes an inner mitten for placement on a human hand, the inner mitten forming an open ended hand receiving chamber therein; an outer mitten forming an open ended heated chamber therein, the heated chamber being dimensioned to capture and removeably retain therein the inner mitten having the human hand inserted therein; means for electrically heating the heated chamber of the outer mitten; means for regulating the temperature at which the electrical heating means operates; and means for storing the hand cream within the inner mitten.

BRIEF DESCRIPTION OF THE DRAWINGS

In order that the present invention may be more fully understood it will now be described, by way of example, with reference to the accompanying drawings in which.

DESCRIPTION OF THE PREFERRED EMBODIMENT

Figure 1:
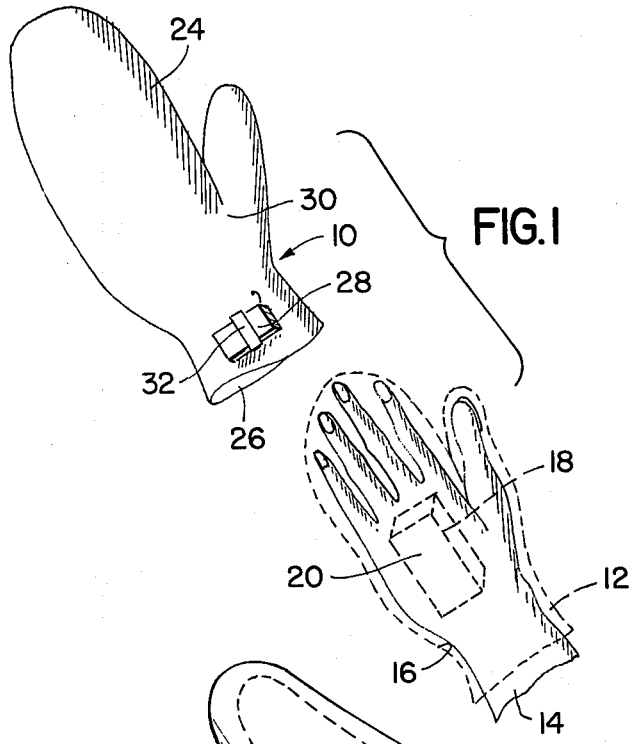
FIG. 1 is an exploded view of the preferred embodiment in perspective.
Figure 3:
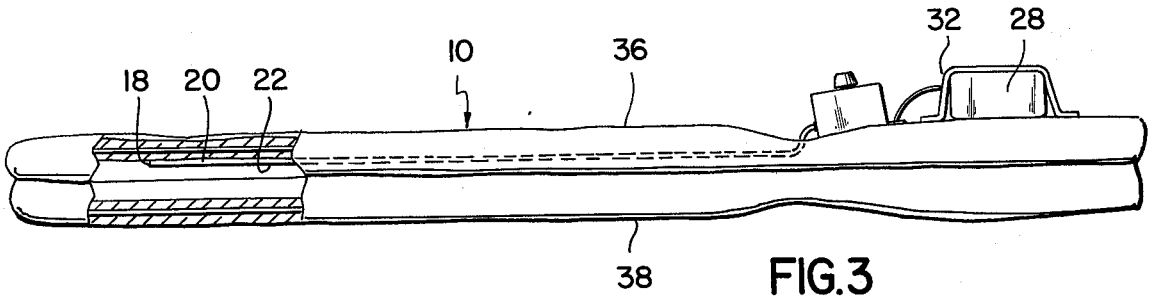
FIG. 3 is a side view in elevation of the preferred embodiment.

Referring now to the figures, and more particularly to FIG. 1, there is illustrated therein a heated mitten 10 for use in conjunction with the application of hand cream or the like. The heated mitten 10 includes an inner mitten 12 shown placed on a human hand 14. The inner mitten 12 forms an open ended hand receiving chamber 16 and is constructed of a liquid impervious material such as a plastic or the like which can be disposed after each use. A reservoir 18 is provided in the inner mitten 12 for the retention of hand cream 20 or the like. The hand cream 20 is sealed within the reservoir 18 by a heat meltable membrane 22 as shown in FIG. 3. When heat is applied to the inner mitten 12 the membrane 22 melts releasing a premeasured quantity of the hand cream 20. Although illustrated with only one reservoir 18 several may be included at various positions throughout the inner mitten 12.

An outer mitten 24 is illustrated and forms an open ended heated chamber 26 therein. The heated chamber 26 is dimensioned to capture and frictionally removeably retain therein the inner mitten 12 on the human hand 14. The outer mitten is preferably constructed of a soft flexible material such as cotton or the like. A battery 28 is secured to the outer surface 30 of the outer mitten 24 by a strap 32 fixedly secured thereto and powers a heating element 34 illustrated in FIG. 2.

Figure 2:
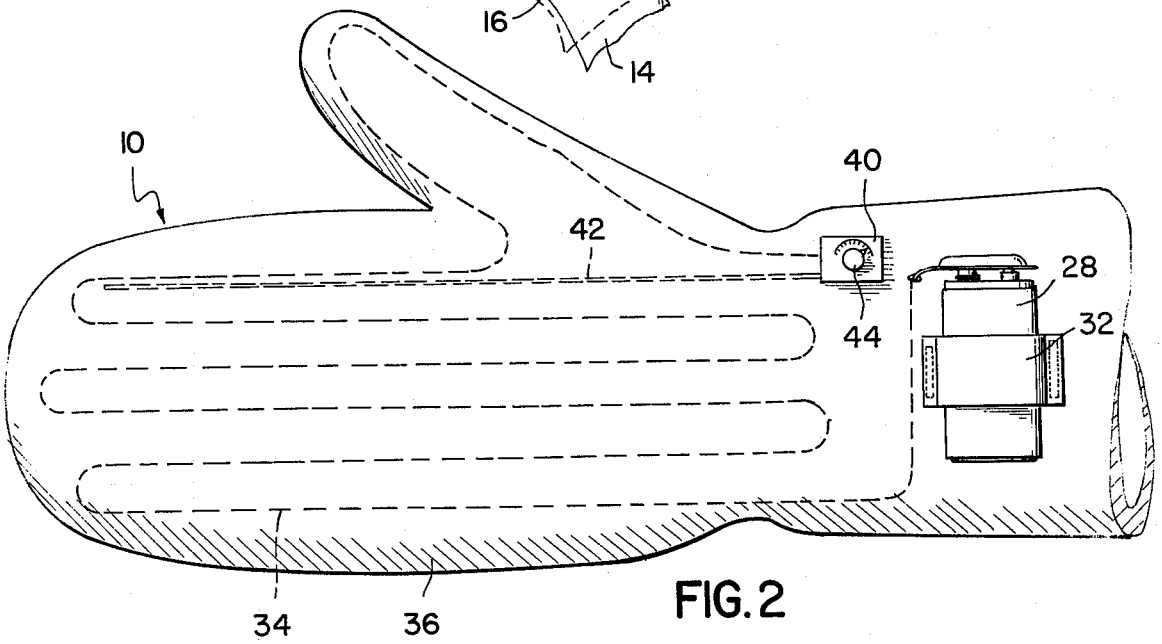
FIG. 2 is a top view of the preferred embodiment incorporating the principles of the present invention therein.

FIG. 2 illustrates the outer mitten 24 and the heating element 34 disposed therein. The heating element 34 is of the resistance type, is covered with an electrical insulating material, and is incorporated in the structure of the mitten 24 by weaving or the like in the upper and lower surfaces 36 and 38 thereof. Although a particular configuration for the heating element 34 is shown, other configurations are also suitable. The heating element 34 is coupled in series to the battery 28 and an adjustable temperature regulating device 40 which is fixedly secured to the outer mitten 24. A heat sensing probe 42 which preferably incorporates conventional thermister type circuitry is located within the outer mitten 24 adjacent to the heated chamber 26 thereof and is operably coupled to the temperature regulating device 40. A desired temperature is set on the control 44 of the temperature regulating device 40 and is maintained within the heated chamber 26 by the probe 42 sensing the temperature of the chamber 26, reporting the temperature to the regulating device 40 and activating and deactivating the heating element 34 as necessary.

FIG. 3 illustrates a side view of the outer mitten 24 partially broken away to reveal the inner mitten 12. The reservoir 18 is illustrated within the receiving chamber 16 of the inner mitten 12. The heat meltable membrane 22 is illustrated sealing the quantity of hand cream 20 within the reservoir 18 prior to the heating of the heated chamber 26 by the heating element 34.

It will be understood that various changes in the details, materials, arrangements of parts and operation conditions which have been herein described in order to explain the nature of the invention may be made by those skilled in the art within the principles and scope of the invention.

Having thus set forth the nature of the invention, what is claimed is:

1. A heated mitten for use in conjunction with the application of hand cream or the like comprising:

an inner mitten for placement on a human hand, said inner mitten forming an open ended hand receiving chamber therein;

an outer mitten forming an open ended heated chamber therein, said heated chamber being dimensioned to capture and removeably retain therein said inner mitten having said human hand inserted therein;

means for electrically heating said heated chamber of said outer mitten;

means for regulating the temperature at which said electrical heating means operates; and means for storing said hand cream within said inner mitten including at least one reservoir provided in said inner mitten for retaining said hand cream therein, said reservoir being covered by a meltable membrane, said membrane retaining said hand cream within said reservoir until a source of artificial heat is applied thereto.

2. A heated mitten as claimed in claim 1, wherein said electrical heating means comprises a heating element located in the structure of said outer mitten, an electrical insulating material covering said heating element, said heating element being adjacent to the upper and lower surfaces of said human hand when inserted within said heated chamber, said heating element being coupled to the electrical powering means.

3. A heated mitten as claimed in claim 1, wherein said regulating means comprises an adjustable temperature regulating device fixedly secured to the outer surface of said outer mitten, a heat sensing probe being operably coupled to said device and being disposed within said outer mitten adjacent to said heated chamber thereof, said heat sensing probe sensing the temperature of said heated chamber and in conjunction with said device activating and deactivating said electrical heating means to maintain a constant temperature within said heated chamber as preselected by the user on said device.

4. A heated mitten as claimed in claim 3, wherein said heat sensing probe incorporates thermister type circuitry to sense changes in temperature.

5. A heated mitten as claimed in claim 1, wherein said inner mitten is constructed of a liquid impervious material.

6. A heated mitten as claimed in claim 1, wherein said inner mitten is constructed of a liquid impervious disposable material.

* * * * *